US006837202B1

(12) United States Patent
Lu

(10) Patent No.: US 6,837,202 B1
(45) Date of Patent: Jan. 4, 2005

(54) ENGINE STARTER FOR REMOTE-CONTROLLED MODEL AIRPLANE

(76) Inventor: Ke-Way Lu, 3F, No. 322, Sec. 6, Min-Chuan E. Rd., Taipei City (TW)

( * ) Notice: Subject to any disclaimer, the term of this patent is extended or adjusted under 35 U.S.C. 154(b) by 0 days.

(21) Appl. No.: 10/661,303

(22) Filed: Sep. 12, 2003

(51) Int. Cl.[7] ..... F02N 11/12

(52) U.S. Cl. ..... 123/179.27; 123/179.25; 74/6; 310/83; 318/45

(58) Field of Search ..... 123/179.27, 179.25, 123/179.26; 74/6, 7 E; 310/83, 112; 318/45

(56) References Cited

U.S. PATENT DOCUMENTS 2,475,750 A * 7/1949 McCormick et al. ..... 318/447
4,323,828 A * 4/1982 Terada et al. ..... 318/45
4,592,243 A * 6/1986 Katoh et al. ..... 74/7 E
4,662,233 A * 5/1987 Mazzorana ..... 74/7 A
4,684,816 A * 8/1987 Mazzorana ..... 290/38 R
5,095,865 A * 3/1992 Keister ..... 123/179.5
5,535,713 A * 7/1996 Braddock ..... 123/179.27
6,700,263 B1 * 3/2004 Kong et al. ..... 310/112

* cited by examiner

*Primary Examiner*—Andrew M. Dolinar
(74) *Attorney, Agent, or Firm*—Ladas & Parry

(57) ABSTRACT

An engine starter includes two motors housed inside a housing, a driven gear wheel meshed between the pinions at the motor shafts of the motors, a first idle gear meshed with an internal gear at the driven gear wheel, a second idle gear coupled to the first idle gear for synchronous rotation, an output gear wheel meshed with the second idle gear, and an output shaft axially extended from the output gear wheel and selectively provided with a socket or starting bar for starting the engine of any of a variety of model vehicles.

1 Claim, 9 Drawing Sheets

ENGINE STARTER FOR REMOTE-CONTROLLED MODEL AIRPLANE

BACKGROUND OF THE INVENTION

1. Field of the Invention

The present invention relates to a remote-controlled model airplane and, more particularly, to a compact engine starter adapted to start the engine of any of a variety of remote-controlled model vehicles.

2. Description of the Related Art

FIG. 8 shows an engine starter for use to start the engine of a model airplane. The engine starter A has its output shaft mounted with a rubber socket B. The rubber socket B can be directly attached to the cone cap 231 of a model airplane (see FIG. 10) to start the engine of the model airplane after connection of the engine starter A to the battery 25 of a car (not shown) through a jumper cable, or attached with a starting bar 21 for insertion into a coupling hole 27 to start the engine of a helicopter (see FIG. 9). This design of engine starter is functional, however it is heavy. When in use, the model vehicle must be carried to the parking area of the car so that the engine starter can be connected to the battery of the car to obtain the necessary working voltage.

SUMMARY OF THE INVENTION

The present invention has been accomplished under the circumstances in view. According to one aspect of the present invention, the engine starter comprises a housing; a first motor mounted inside the housing, the first motor having a first pinion fixedly mounted on a motor shaft thereof; a second motor mounted inside the housing, the second motor having a second pinion fixedly mounted on a motor shaft thereof and being electrically coupled to the first motor for synchronous forward rotation; a battery power supply means adapted to provide the first motor and the second motor with the necessary working voltage; a driven gear wheel meshed with the first pinion and the second pinion for backward rotation upon forward rotation of the first motor and the second motor, the driven gear wheel comprising an internal gear; an idle gear set, the idle gear set comprising a first idle gear meshed with the internal gear for backward rotation with the driven gear wheel, and a second idle gear axially connected to the first idle gear for synchronous rotation with the first idle gear; an output gear wheel meshed with the second idle gear for forward rotation upon backward rotation of the second idle gear; and an output shaft fixedly and axially connected to the center of the output gear wheel for forward rotation with the output gear wheel. According to another aspect of the present invention, the output shaft of the engine starter can be mounted with a socket for securing to the cone cap of the propeller of a model airplane to start the engine of the model airplane. According to still another aspect of the present invention, the output shaft of the engine starter can be mounted with a starting rod for starting the engine of a helicopter. Further, by means of changing the design of the reduction gear set, the engine start is set to start the engine of a model car.

DETAILED DESCRIPTION OF THE PREFERRED EMBODIMENT

Figure 1:
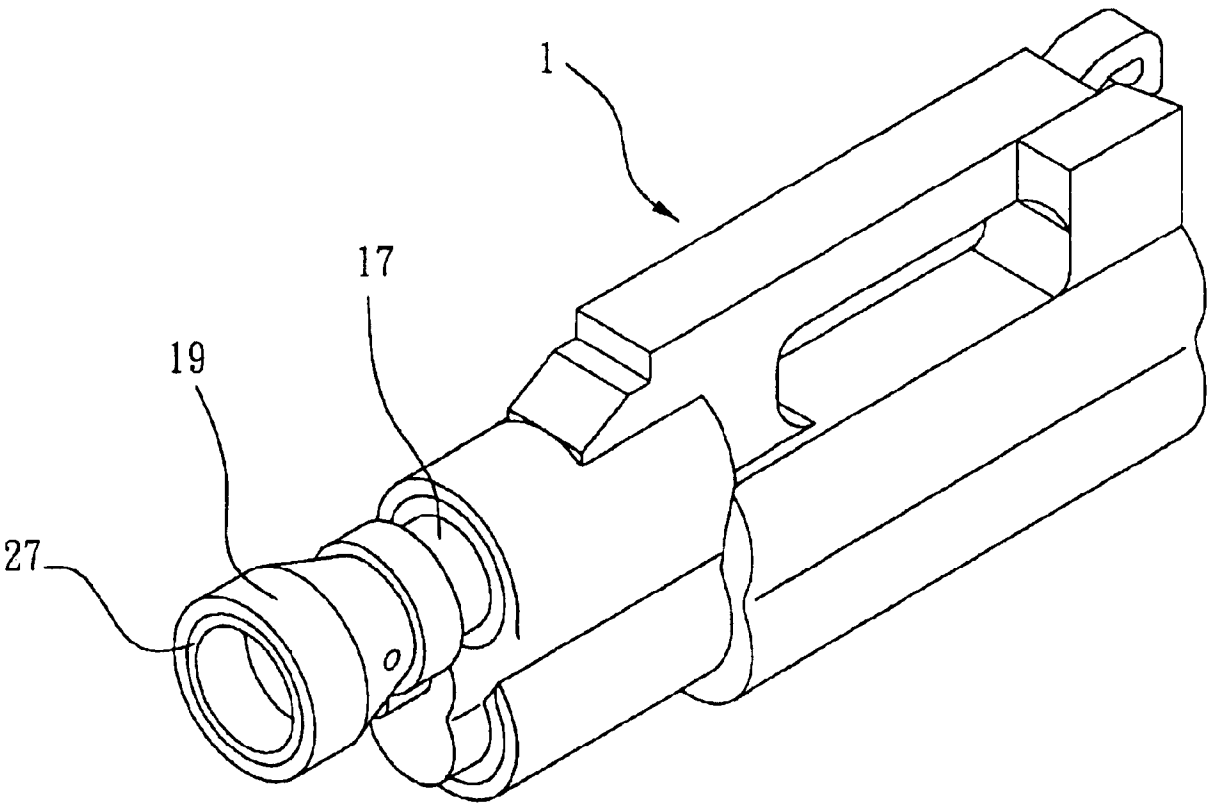
FIG. 1 is an elevational view of an engine starter according to the present invention.

FIG. 1 illustrates the outer appearance of an engine starter constructed according to the present invention. As illustrated, the engine starter has an output shaft 17 at the front side of the housing 1, a relatively hard plastic socket 19 fastened to the output shaft 17, and a relatively soft resilient rubber bush 27 fastened to the inner diameter of the plastic socket 19.

Figure 2:
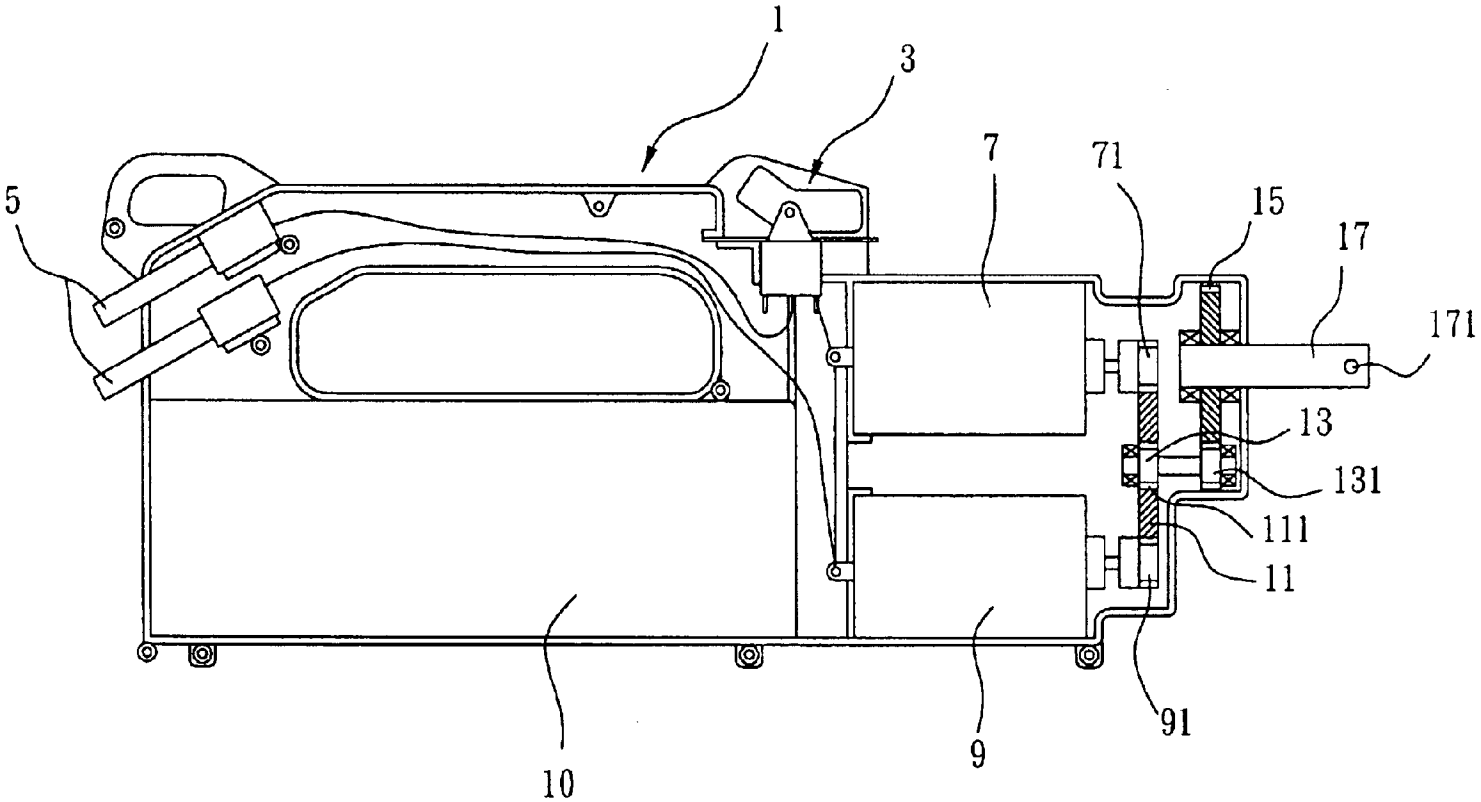
FIG. 2 is a side plain view in section of the engine starter according to the present invention.

Referring to FIG. 2, the housing 1 houses two battery cells 10 (in the drawing, the two battery cells are arranged in a stack), battery connector terminals 5, a switch 3, a first motor 7, a second motor 9, and a reducing gear set. The switch 3 has a part disposed at the outside of the housing 1 for operation by the user. The first motor 7 and the second motor 9 are electrically coupled to the switch 3. By means of operating the switch 3, the first and second motors 7 and 9 are simultaneously turned on or off. The battery connector terminals 5 are to be electrically coupled to the positive and negative terminals of the battery cells 10 to let battery power be transmitted to the first and second motors 7 and 9.

The aforesaid reduction gear set comprises a first pinion 71 and a second pinion 91 respectively installed at the first motor 7 and the second motor 9, a driven gear wheel 11, an idle gear set, and an output gear wheel 15. The driven gear wheel 11 is pivotally mounted inside the housing 1 and meshed between the first pinion 71 and the second pinion 91, having an internal gear 111. The idle gear set comprises a first idle gear 13 and a second idle gear 131. The first idle gear 13 and the second idle gear 131 have a common center gear shaft pivotally supported in axle bearings inside the housing 1. The first idle gear 13 meshes the internal gear 111 of the driven gear wheel 11. The second idle gear 131 meshes the output gear wheel 15. The aforesaid output shaft 17 is fixedly and axially connected to the center of the output gear wheel 15. The output shaft 17 has a pin hole 171 near the distal end.

When controlling the first motor 7 and the second motor 9 to rotate forwards, a relatively greater output power is provided to rotate the driven gear wheel 11 backwards, thereby causing the internal gear 111 to rotate the first idle gear 13 and the second idle gear 131 backwards, and therefore the second idle gear 131 drives the output gear wheel 15 and the output shaft 17 to rotate forwards.

Figure 3:
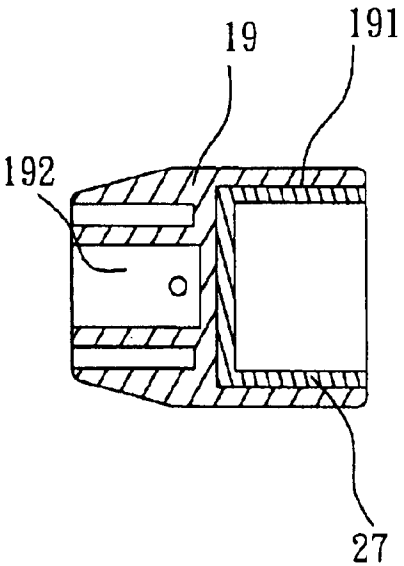
FIG. 3 is a sectional view of a plastic socket for use with the engine starter according to the present invention.

Before starting the engine of a model airplane, the plastic socket 19 (see FIGS. 1 and 3) or a starting bar 21 (see FIG.

4) should be attached to the output shaft 17. The plastic socket 19 is a hollow cylindrical member molded of hard plastics, having a coupling hole 191 disposed at one end, which accommodates the aforesaid relatively soft resilient rubber bush 27, an axial hole 192 disposed at the other end, an annular groove 193 extended around the axial hole 192, and a radial through hole extended across the axial hole 192.

Figure 5:
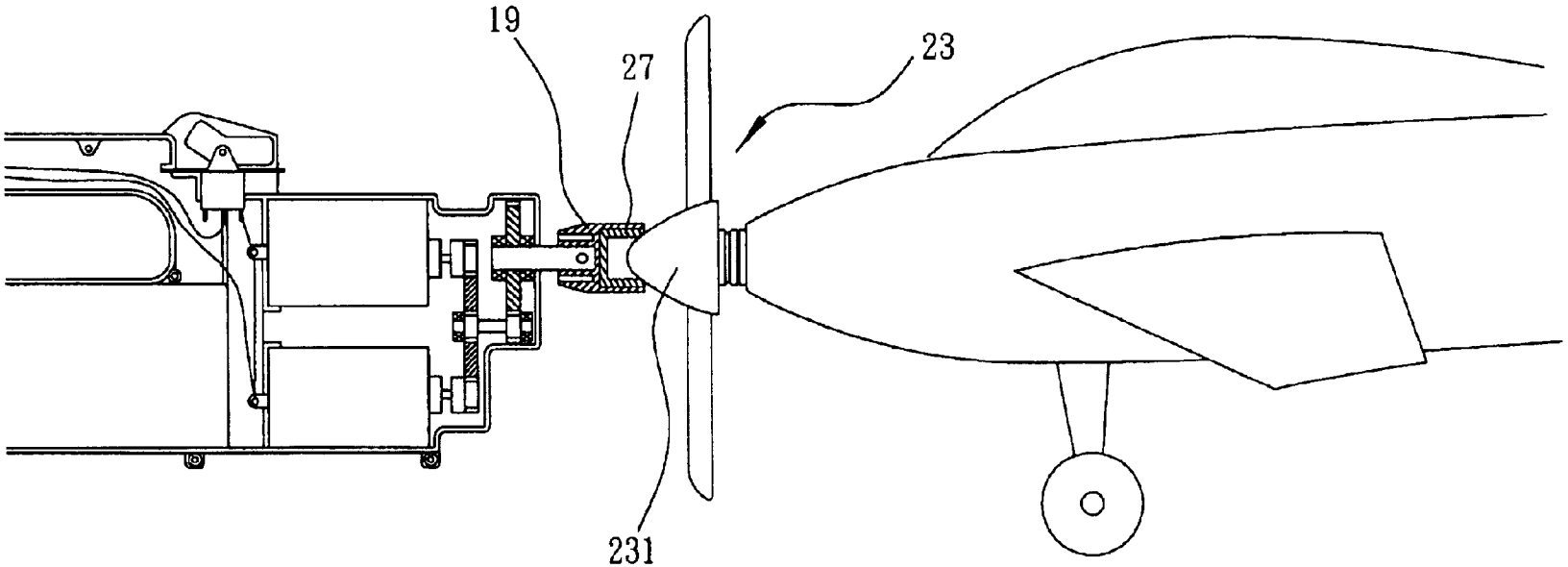
FIG. 5 is an applied view of the present invention, showing the engine starter mounted with the plastic socket and coupled to the cone cape of the propeller of a model airplane.

In case the plastic socket 19 is used, the output shaft 17 is inserted into the axial hole 192, and then a lock pin (not shown) is fastened to the pin hole 171 of the output shaft 17 and the radial through hole of the plastic socket 19 to lock the plastic socket 19 to the output shaft 17. After installation of the plastic socket 19 at the output shaft 17, the rubber bush 27 is attached to the cone cap 231 of the propeller 23 of the model airplane (see FIG. 5), and then turn on the engine starter to rotate the propeller 23 of the model airplane.

Figure 4:
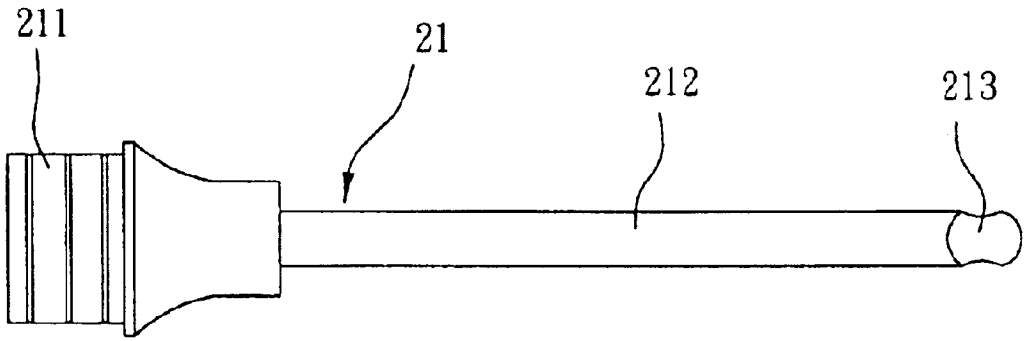
FIG. 4 is a sectional view of a starting bar for use with the engine starter according to the present invention.
Figure 6:
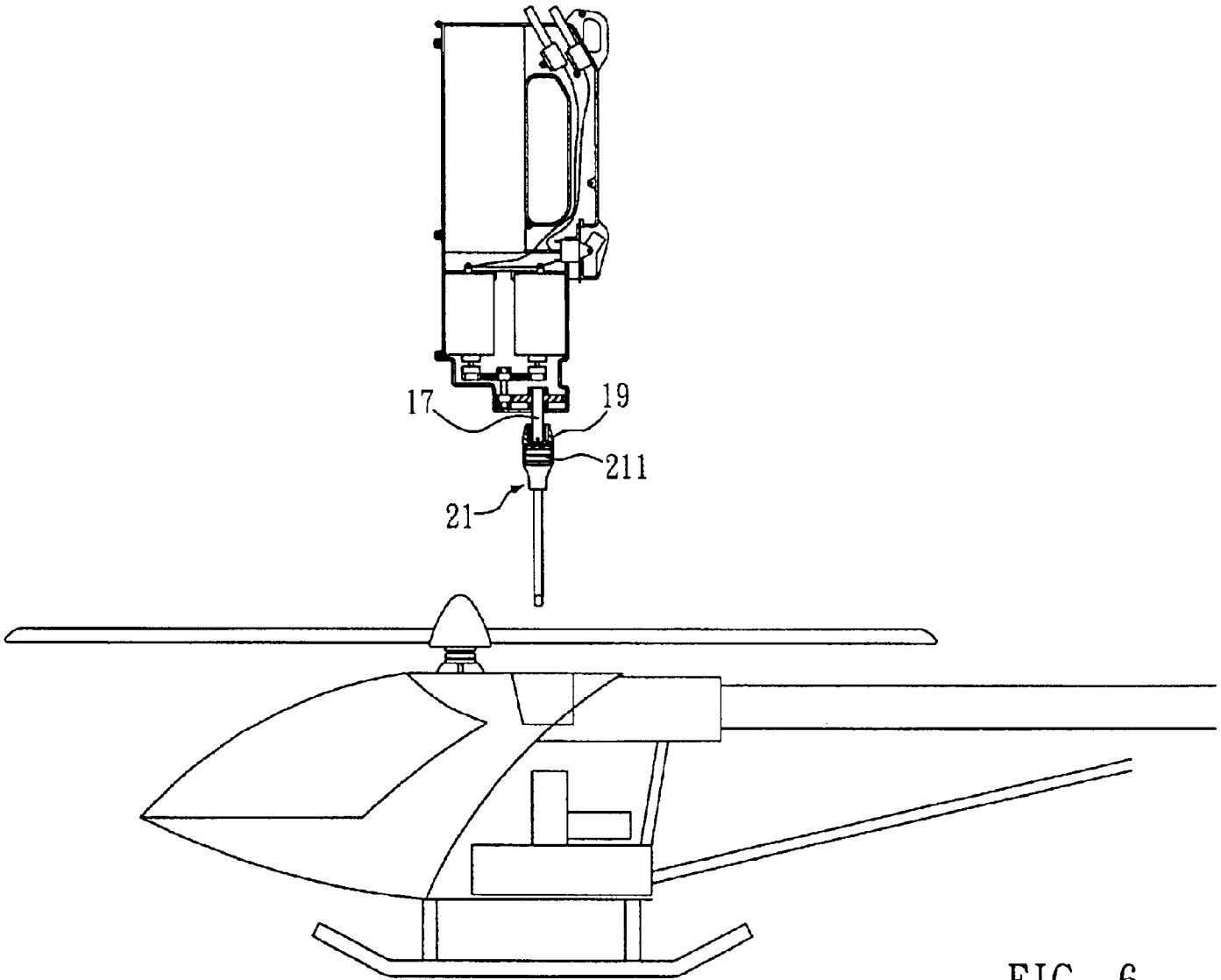
FIG. 6 is another applied view of the present invention, showing the engine starter mounted with the starting bar for use to start the engine of a model helicopter.

The aforesaid starting bar 21 is an elongated rod member 212 having a driving tip 213 at one end and a connector 211 at the other end (see FIG. 4). In case the starting bar 21 is used to start the engine of a model helicopter as shown in FIG. 6, the connector 211 is press-fitted into the rubber bush 27 at the plastic socket 19, and then the driving tip 213 is inserted into the coupling hole at the engine of the model helicopter, and then the engine starter is turned on to rotate the starting bar 21 and the engine of the model helicopter.

Figure 7:
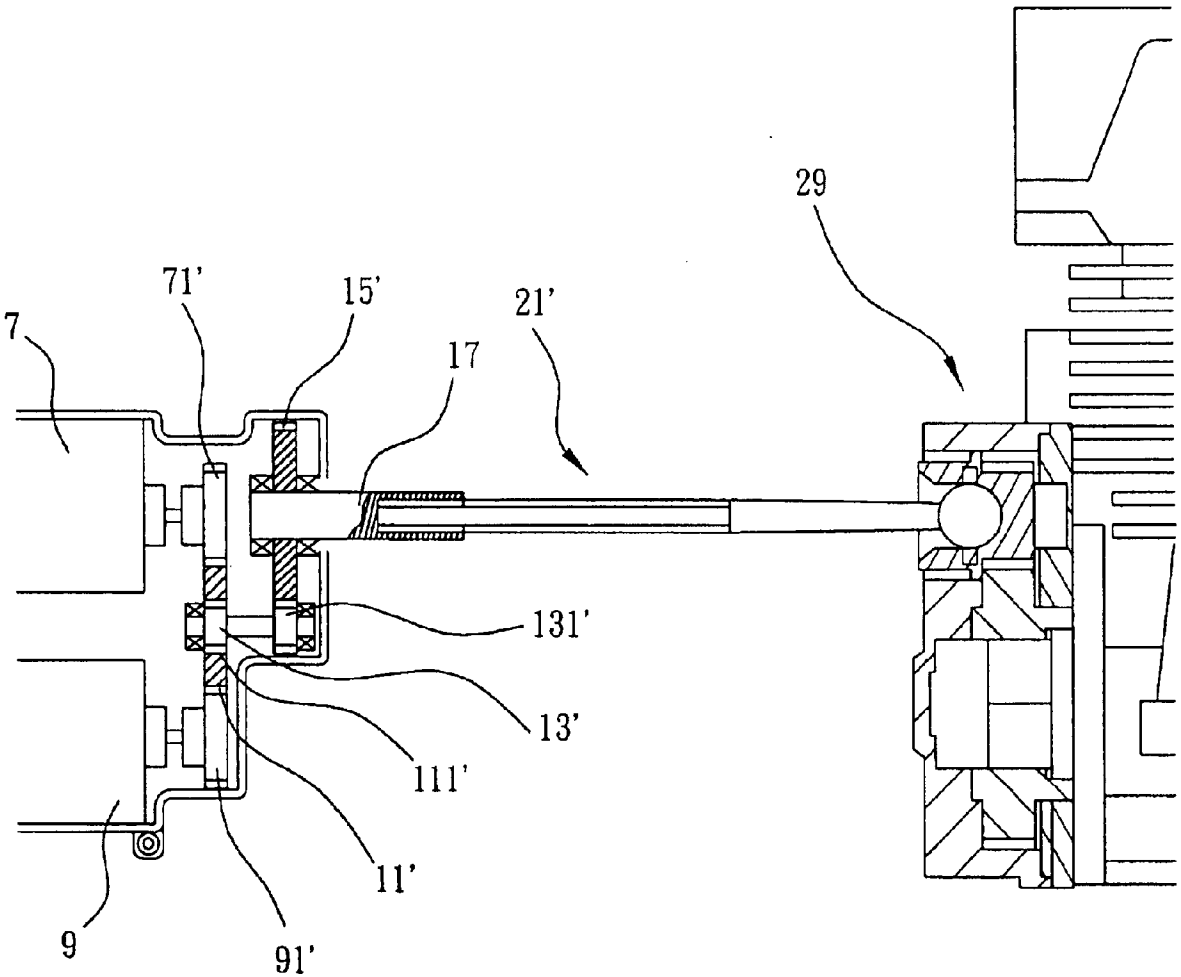
FIG. 7 is a schematic sectional view of an alternate form of the present invention, showing the engine starter mounted with a starting bar and coupled to the engine of a model car.
Figure 8:
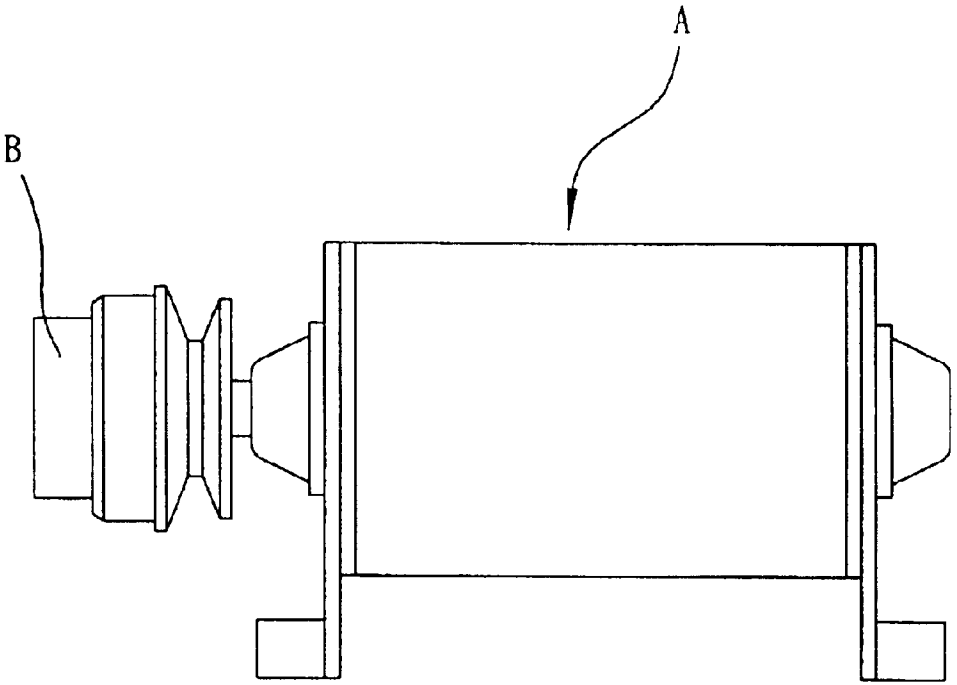
FIG. 8 is a plain view of an engine starter according to the prior art.
Figure 9:
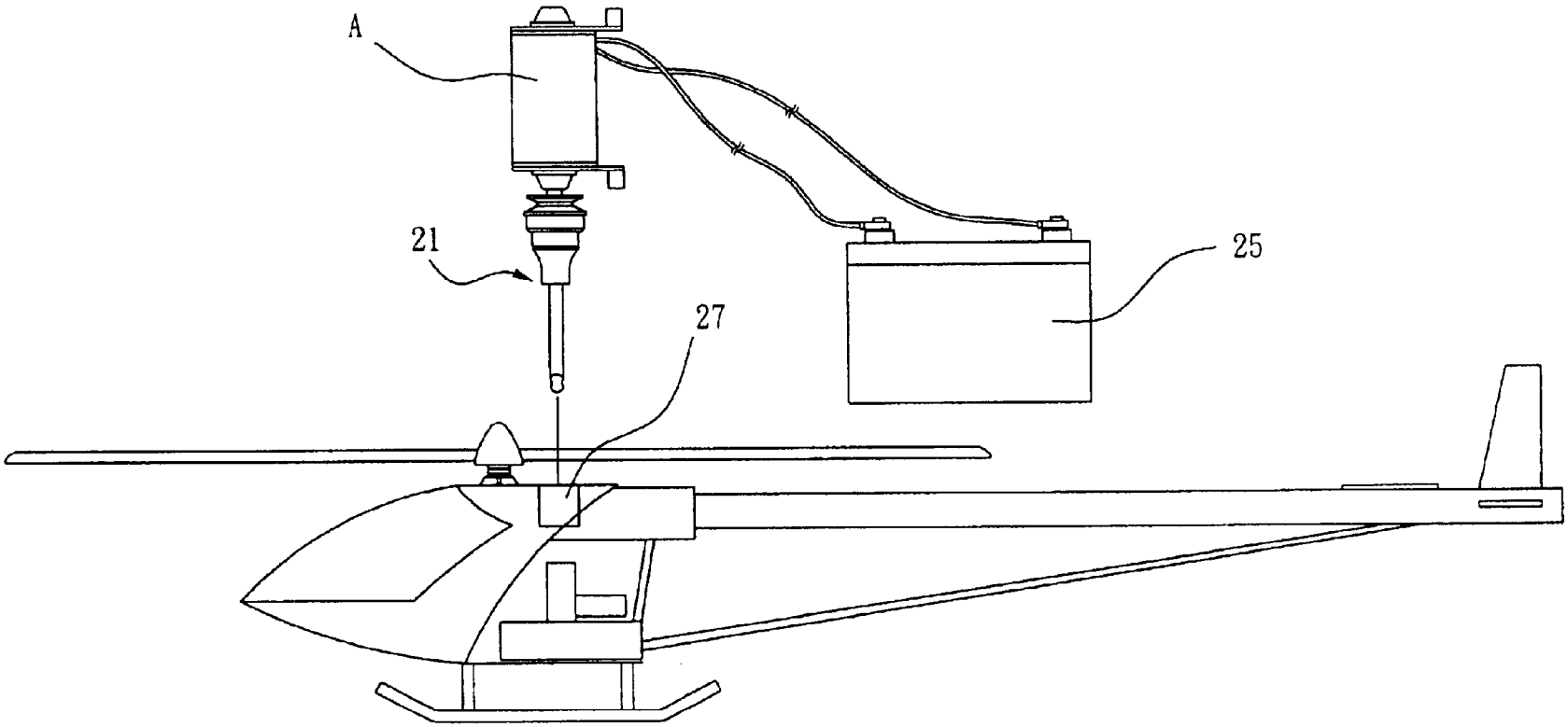
FIG. 9 shows an application example of the prior art engine starter.
Figure 10:
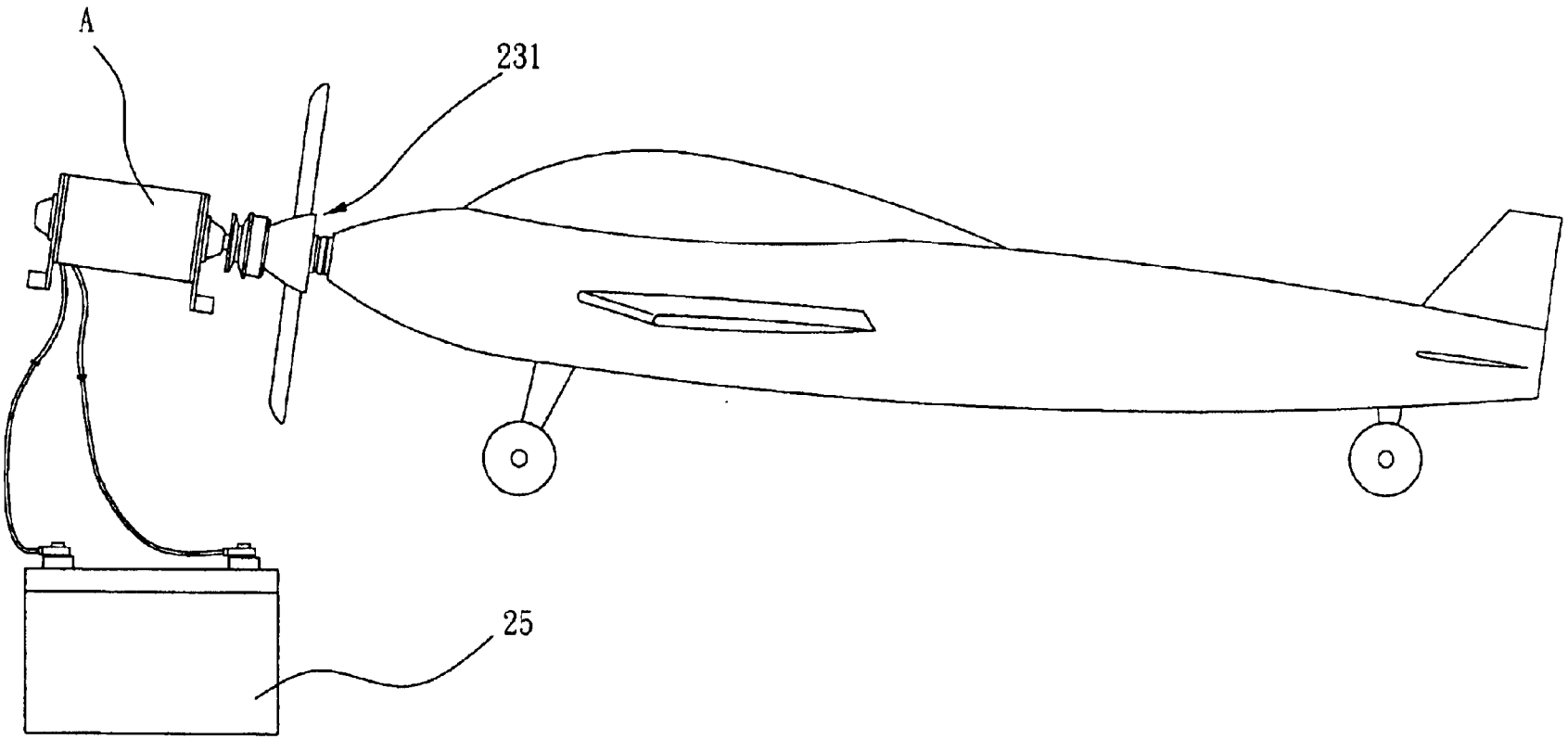
FIG. 10 shows another application example of the prior art engine starter.

FIG. 7 shows an alternate form of the engine starter for use with a starting bar 21' to start the engine of a model car According to this embodiment, the first and second pinions 71' and 91' have a relatively greater diameter and greater number of teeth; the driven gear wheel 11 has a relatively smaller diameter and smaller number of teeth; the first idle gear 13' and the second idle gear 131' are respectively meshed with the internal gear 111' of the driven gear wheel 11' and the output gear wheel 15'; the output shaft 17 is fixedly and axially connected to the center of the output gear wheel 15 for output of rotary driving force to the engine of a model car 29 through the starting bar 21'.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An engine starter adapted to start the engine of a remote-controlled model airplane, comprising:

a housing;

a first motor mounted inside said housing, said first motor having a first pinion fixedly mounted on a motor shaft thereof;

a second motor mounted inside said housing, said second motor having a second pinion fixedly mounted on a motor shaft thereof and being electrically coupled to said first motor for synchronous forward rotation;

a battery power supply means adapted to provide said first motor and said second motor with the necessary working voltage;

a driven gear wheel meshed with said first pinion and said second pinion for backward rotation upon forward rotation of said first motor and said second motor, said driven gear wheel comprising an internal gear;

an idle gear set, said idle gear set comprising a first idle gear meshed with said internal gear for backward rotation with said driven gear wheel, and a second idle gear axially connected to said first idle gear for synchronous rotation with said first idle gear;

an output gear wheel meshed with said second idle gear for forward rotation upon backward rotation of said second idle gear; and an output shaft fixedly and axially connected to the center of said output gear wheel for forward rotation with said output gear wheel.

* * * * *